US006716083B1

(12) United States Patent
Castro

(10) Patent No.: US 6,716,083 B1
(45) Date of Patent: Apr. 6, 2004

(54) BALLOON WEIGHT

(76) Inventor: Antonio L. Castro, 11552 New London Dr., St. Louis, MO (US) 63141

( * ) Notice: Subject to any disclaimer, the term of this patent is extended or adjusted under 35 U.S.C. 154(b) by 0 days.

(21) Appl. No.: 10/315,740

(22) Filed: Dec. 9, 2002

(51) Int. Cl.[7] ..... A63H 3/06

(52) U.S. Cl. ..... 446/220; 446/236; 242/405; 248/346.01

(58) Field of Search ..... 446/220, 223, 446/226, 235, 236, 247, 248, 486; 248/346.01; 242/405, 405.1, 405.2, 405.3

(56) References Cited

U.S. PATENT DOCUMENTS

| | | | | | |
|---|---|---|---|---|---|
| 415,423 | A | * | 11/1889 | Smith | 242/405 |
| 4,936,532 | A | | 6/1990 | Williams | |
| 4,993,664 | A | | 2/1991 | Kneeland | |
| 5,011,447 | A | * | 4/1991 | Watanabe | 446/220 |
| 5,035,391 | A | | 7/1991 | Steele et al. | |
| 5,074,510 | A | * | 12/1991 | Metz | 248/176.1 |
| 5,188,314 | A | * | 2/1993 | Peters | 244/31 |
| 5,240,199 | A | * | 8/1993 | Peters | 242/405.1 |
| 5,259,805 | A | | 11/1993 | Kieves | |
| 5,411,427 | A | | 5/1995 | Nelson et al. | |
| 5,628,091 | A | | 5/1997 | Mueller | |
| 5,662,510 | A | | 9/1997 | Wolens | |
| 5,755,419 | A | | 5/1998 | Gearhart et al. | |
| 5,797,783 | A | | 8/1998 | Harris | |
| D401,255 | S | | 11/1998 | Burns | |
| D414,222 | S | | 9/1999 | Kieves et al. | |
| D415,841 | S | | 10/1999 | Kieves et al. | |
| 5,989,093 | A | | 11/1999 | Nelson et al. | |
| 6,076,758 | A | * | 6/2000 | Kieves et al. | 242/400.1 |
| 2001/0034176 | A1 | | 10/2001 | Deliu | |

* cited by examiner

*Primary Examiner*—Jacob K. Ackun
*Assistant Examiner*—Bena B. Miller
(74) *Attorney, Agent, or Firm*—Joseph A. Fuchs; Bell, Boyd & Lloyd LLC

(57) ABSTRACT

The present invention provides a balloon assembly including a balloon, and a balloon weight. The balloon weight has a plate having a perimeter, and an annular outer flange disposed on the plate. The outer flange has an outer surface. The invention also includes a cup rotatably connected to the plate. The cup has a bottom opposite the plate, and an annular side wall. The side wall encompasses the outer flange. The side wall also includes a first opening. An umbrella-shaped hook extends from the plate perimeter. A ribbon is wrapped around the outer surface of the outer flange, and extends through the first opening in the side wall. The ribbon has a length including a distal end. A peg is attached to the distal end of the ribbon. The peg is insertable through a portion of the balloon to secure the distal end of the ribbon to the balloon.

32 Claims, 7 Drawing Sheets

BALLOON WEIGHT

BACKGROUND OF THE INVENTION

The present invention relates to a weight for fixedly tethering a balloon. Balloons, including lighter-than-air balloons, are well-known in the art. Lighter-than-air balloons are used for decorations at parties, given as gifts, and presented to persons with floral or other arrangements at special occasions such as graduations, birthdays, Valentine's Day, and Mothers' Day. Such balloons often bear an indicia of the occasion, such as "Happy Birthday," "Over the Hill," or "Congratulations."

Lighter-than-air balloons are typically filled with helium, but may be filled with any lighter-than-air gas. Thus, the balloons float in air. The balloons may be made from a variety of materials, including natural or synthetic rubber, polyester, metallized polyester, nylon, or metallized nylon. If untethered, the balloons would float uncontrolled.

Often, for display in retail stores, balloon weights have been employed, with the balloon attached to the weight by a string or ribbon. Weights, however, may be unsightly, and string or ribbon must be tied to the weight. Balloons are also sometimes tied to any stable object to prevent them from floating away. Tying and untying balloons when a customer purchases them is time-consuming for the store clerk.

Balloon weights have been developed that have a pre-assembled weight, a length of ribbon, and sometimes adhesive to attach the balloon to the ribbon. Examples of such weights are disclosed in U.S. Pat. Nos. 5,989,093 and 6,076,758. These prior art balloon weights often have hooks extending from them, and are adapted to be hung from a tack or other similar device. These weights also can include a catch to prevent the ribbon from unraveling under the buoyancy force of the balloon. To rewind the ribbon, it must also be manually aligned onto a spool increasing the likelihood of misalignment and accidental unwinding. Moreover, the adhesive attaching the balloon to the ribbon may lose tackiness, permitting the balloon to become detached from the ribbon.

SUMMARY OF THE INVENTION

In one embodiment, the present invention provides a balloon weight including a plate having a perimeter, and an annular outer flange disposed on the plate. It also includes a cup rotatably connected to the plate. The cup has a bottom opposite the plate, and an annular side wall extending from the bottom. The side wall encompasses the outer flange, and includes a first opening. An umbrella-shaped hook extends from the plate perimeter.

In another embodiment, the present invention provides a balloon assembly including a balloon, and a balloon weight. The balloon weight has a plate having a perimeter, and an annular outer flange disposed on the plate. The outer flange has an outer surface. The embodiment also includes a cup rotatably connected to the plate. The cup has a bottom opposite the plate, and an annular side wall. The side wall encompasses the outer flange. The side wall also includes a first opening. An umbrella-shaped hook extends from the plate perimeter. A ribbon is wrapped around the outer surface of the outer flange, and extends through the first opening in the side wall. The ribbon has a length including a distal end. A peg is attached to the distal end of the ribbon. The peg is insertable through a portion of the balloon to secure the distal end of the ribbon to the balloon. In a further aspect, the female inner flange has an inner surface, the inner surface includes an annular indentation, and the circular male flange includes an outer surface having an annular ring engageable with the annular indentation.

The present invention facilitates easy ribbon rewinding within the weight to prevent accidental unwinding. It also provides a more secure attachment between the balloon and ribbon. Additional features and advantages of the present invention are described in, and will be apparent from, the following Detailed Description of the Invention and the figures.

DETAILED DESCRIPTION OF THE INVENTION

Figure 1:
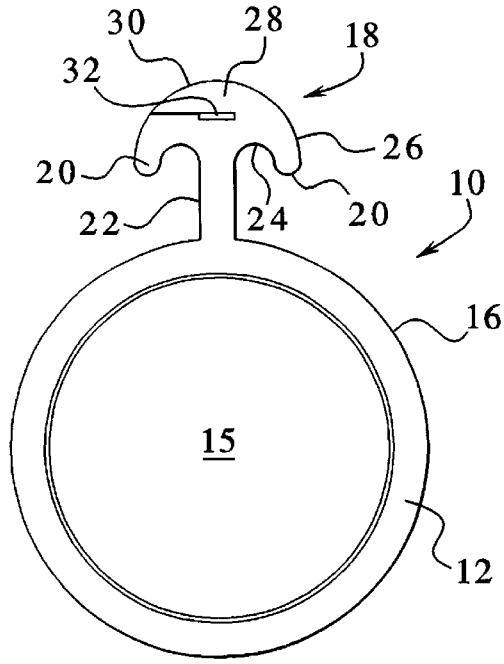
FIG. 1 is a side plan view of a balloon weight of an embodiment of the present invention.
Figure 2:
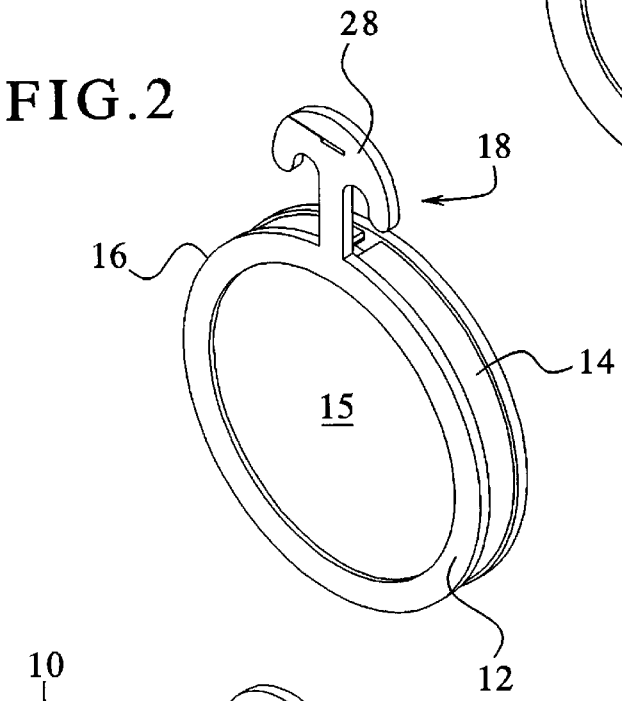
FIG. 2 is perspective view of a balloon weight of an embodiment of the present invention.
Figure 3:
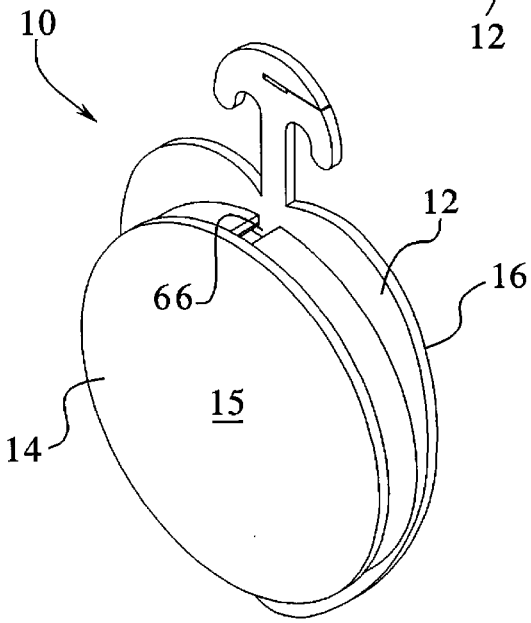
FIG. 3 is a perspective view of a balloon weight of another embodiment of the present invention.

FIGS. 1 and 2 show a plan view and a perspective view, respectively, of a balloon weight 10 of an embodiment of the present invention. The balloon weight 10 includes a plate 12 and a cup 14. The plate 12 has a perimeter 16. The plate 12 is preferably circular, but may be any suitable shape, such as octagonal, or may be decoratively shaped, such as heart-shaped as in FIG. 3. The plate 12 and cup 14 are preferably made of a plastic material, but may be made of any suitable material.

Figure 15:
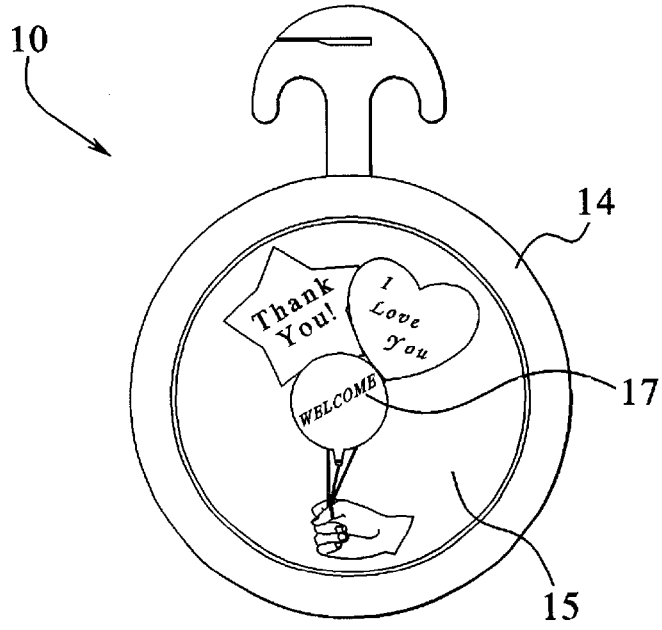
FIG. 15 is a side view of a balloon weight of an embodiment of the present invention.

Either or both the plate 12 and cup 14 may include an indicia-bearing surface 15. The indicia-bearing surface 15 may include an indicia 17 (FIG. 15) embossed onto the plate 12 or cup 14, or may accommodate an indicia 17 adhered or otherwise affixed to the indicia-bearing surface 15.

Extending, preferably perpendicularly, from the perimeter 16 of the plate 12 is an umbrella-shaped hook 18. The hook 18 preferably lies in the same plane as the plate 12. The umbrella-shaped hook 18 includes a pair of extensions 20 extending from either side of a stem 22. The stem 22 is preferably integral with the outer perimeter 16 of the plate 12. The extensions 20 are preferably U-shaped, and include a base 24 and leg 26. The extensions 20 are secured onto a nail, tack, dowel, or other device (not shown) in contact with the base 24. The leg 26 retains the hook 18 on the nail, dowel or other device. Either one extension 20 alone with one device, or both extensions 20 simultaneously may be used with two devices. The hook 18 also includes a crown 28 and an outer edge 30. The crown 28 includes a slot 32 in communication with the outer edge 30 of the hook 18.

As shown in FIGS. 9–13, disposed on the plate 12 is an outer flange 34. The flange 34 is preferably disposed about a center of the plate 12. The outer flange 34 has an outer surface 38. The outer flange 34 includes and a first opening 39 preferably extending the width of the outer flange 34. Wrapped around the outer surface 38 of the outer flange 34 is a first ribbon 40. The first ribbon 40 may be wrapped either clockwise or counterclockwise around the outer surface 38 of the outer flange 34. The first ribbon 40 has a distal end 42 and a second end 44. The first ribbon 40 is made of any suitable material, but is preferably plastic. Attached to the distal end 42 of the first ribbon 40 is a peg 46. The peg 46 is preferably made of plastic, but may be any suitable material. The peg 46 includes a base 48, and a pair of extensions 50. The extensions 50 each include an arm 52 and a finger 54. The arm 52 preferably extends perpendicularly from the base 48 of the peg 46, and the finger 54 extends perpendicularly from the arm 52. Both arms 52 extend in the same direction. The fingers 54 extend toward each other. The distal end 42 of the first ribbon 40 is preferably tied around a central portion 56 of the peg 46 between extensions 50. The second end 44 of the first ribbon 40 is inserted into the first opening 39 of the outer flange 34 and a knot tied into the second end 44 to secure the first ribbon 40 to the outer flange 34. Alternatively, the outer flange 34, has a second opening 41. The second opening 41 may accommodate a second end of a second ribbon 43 such that two ribbons may be used for multiple balloons (FIG. 14). The plate 12 also includes a circular female inner flange 58. The inner flange 58 is concentric with the outer flange 34. The female inner flange 58 has an inner surface 59 and an outer surface 61.

Figure 4:
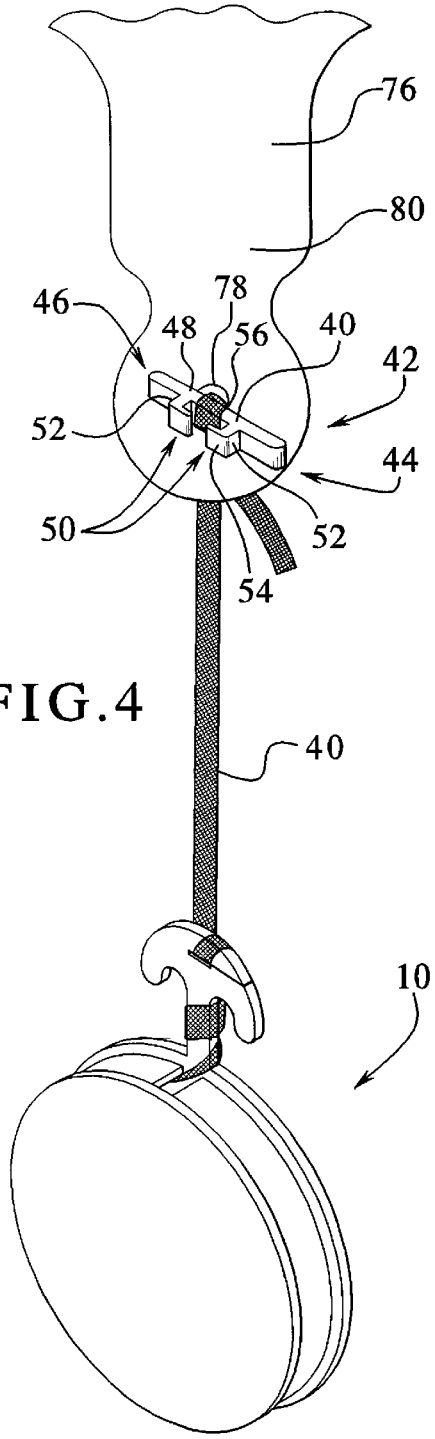
FIG. 4 is a perspective view a balloon weight attached to a balloon in accord with an embodiment of the present invention.
Figure 5:
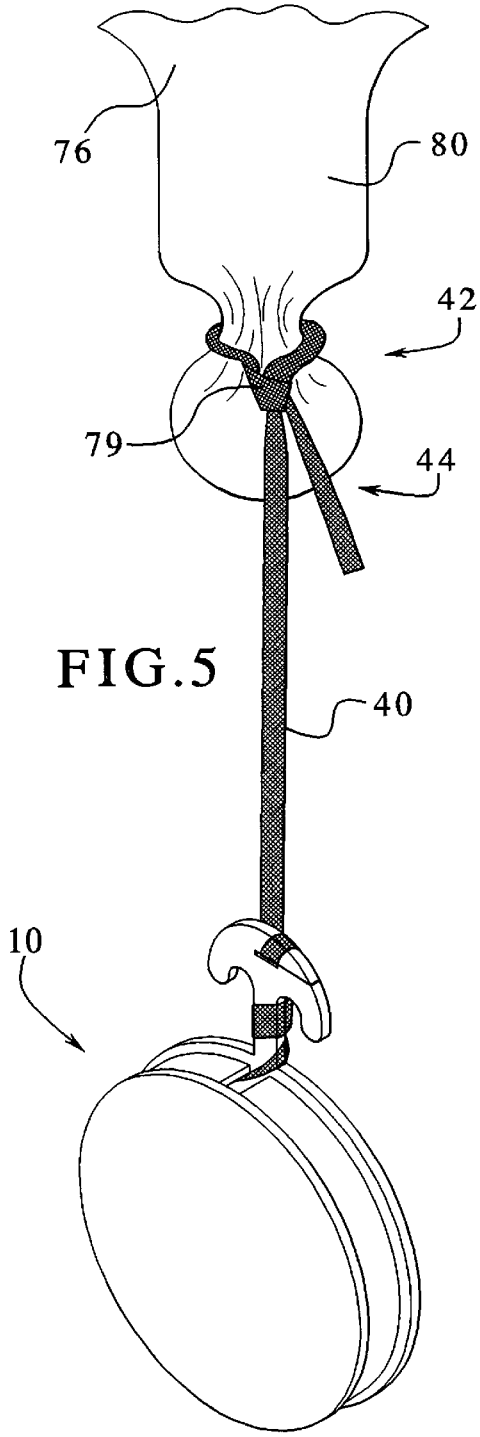
FIG. 5 is a perspective view a balloon weight attached to a balloon in accord with another embodiment of the present invention.

As shown in FIGS. 9–12, the cup 14 includes a bottom 60 and an annular side wall 62 extending substantially perpendicularly from the bottom 60. The side wall 62 is centered about the center of the bottom 60. The side wall 62 has an opening 66 extend across its width. As shown in FIGS. 4 and 5, when the plate 12 and cup 14 are rotatably connected, the first ribbon 40 extends through the opening 66. The bottom 60 also includes a circular male flange 68 concentric with the side wall 62, but with a smaller diameter than the side wall 62. The male flange 68 has an inner surface 67 and an outer surface 69. It will be understood that the female inner flange 58 may also be located on the bottom 60 of the cup 14, and the male flange 68 may be located on the plate 12.

As shown best in FIGS. 9–12, to rotatably connect the plate 12 and cup 14, the male flange 68 attached to the cup 14 and female inner flange 58 of the plate 12 are aligned, and the male flange 68 inserted into the female inner flange 58. The outer surface 69 of the male flange 68 forms a "snap" fit with the inner surface 59 of the female flange 58. The outer surface 69 of the male flange 68 includes an annular ring 71 around its circumference. The inner surface 59 of the female flange 58 includes an annular indentation 73 around its circumference. As the male flange 68 is inserted into the female flange 58, the annular ring 71 engages the annular indentation 73 to form a "snap" fit between the cup 14 and plate 12. If extra weight is desired, before connecting the plate 12 and cup 14, the weight ring 70 is placed against the plate 12 such that the central opening 74 accommodates the female inner flange 58 before inserting the male flange 68 into the female flange 58. When rotatably connected, the side wall 62 of the cup 14 encompasses the outer flange 34 of the plate 12.

Figure 13:
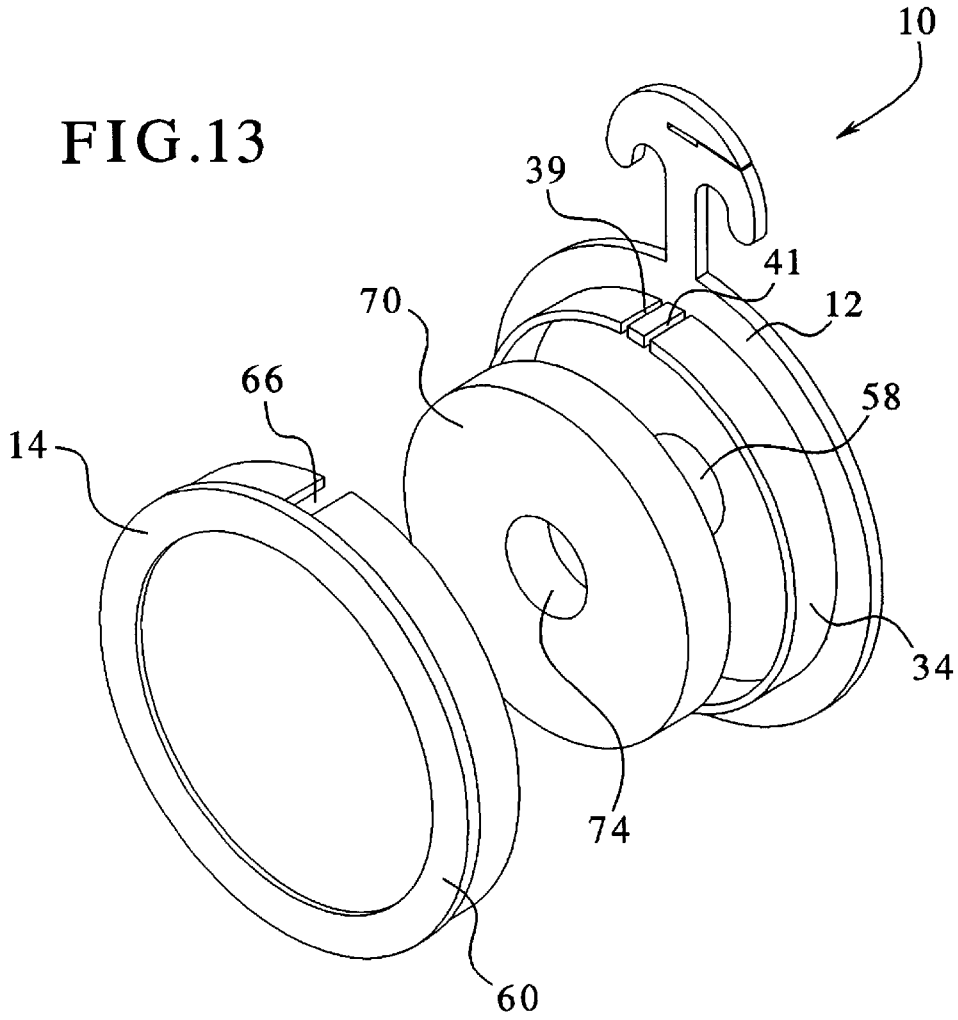
FIG. 13 is an exploded view of a balloon weight of an embodiment of the present invention.
Figure 14:
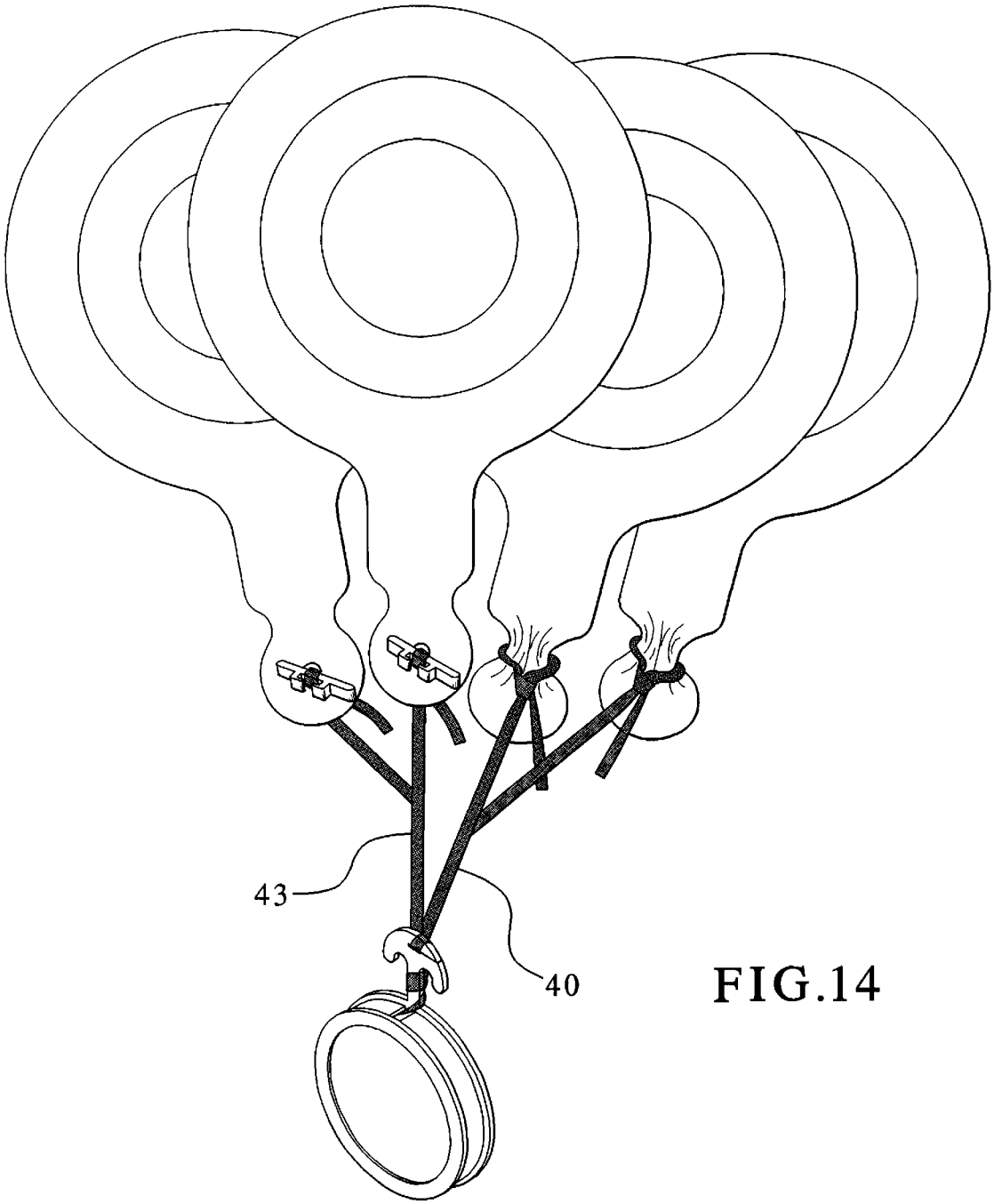
FIG. 14 is a perspective view of a balloon weight attached to multiple balloons in accord with an embodiment of the present invention.

FIG. 13 shows an exploded view of an embodiment of the balloon weight 10 of the present invention. FIG. 13 shows the cup 14, plate 12, and a circular weight ring 70. The weight ring 70 is removably insertable between the bottom 60 of the cup 14 and the plate 12. The weight ring 70 is preferably made of metal, but may be made of any suitable material. The weight ring 70 is used when additional weight is necessary to keep a large balloon, or a number of balloons secured. The weight ring 70 is of a thickness and shape sufficient to permit it to fit between the bottom 60 of the cup 14 and the plate 12 when the two are rotatably connected. The weight ring 70 has a central opening 74 sized to accommodate the female inner flange 58 of the plate 12. The central opening 74 is of a slightly greater diameter than the diameter of the outer surface 61 of the female flange 58.

FIG. 4 shows the peg 46 securing the first ribbon 40 to a balloon 76. The balloon 76 has an opening 78 in a stem 80. The peg 46 is inserted through the opening 78. The opening 78 is of a diameter small enough to permit the peg 46 to be inserted lengthwise but not removed when the peg 46 is crosswise. Alternately, one end of the peg 46 may have a piercing point to pierce the stem 80 of the balloon 76. The peg 46 may be inserted through openings 78 in multiple balloons 76.

FIG. 5 shows an alternative method of attaching the first ribbon 40 to a balloon 76. A slip knot 79 may be tied in the distal end 42 of the first ribbon 40, and around the stem 80 of the balloon 76.

In use, first ribbon 40 is dispensed from the balloon weight 10 by manually pulling it, causing the first ribbon 40 to contact a side 82 of the opening 66 in the side wall 62 of the cup 16. This force causes the cup 14 to rotate with respect to the plate 12. The first ribbon 40 thereby unwraps from the outer surface 38 of the outer flange 34. When the desired length of first ribbon 40 has been dispensed, the friction in the press fit between the female flange 58 and male flange 68 is generally sufficient to resist further dispensing caused by the buoyancy force of the balloon 76. Alternatively, the first ribbon 40 may be wrapped around the stem 22, and inserted into the slot 32 in the crown 28 of the umbrella-shaped hook 18 to act as a stop from additional dispensing of the first ribbon 40.

FIG. 14 shows four balloons 76 attached to the balloon with 10. FIG. 14 shows a first ribbon 40 and a second ribbon 43. Each of the first and second ribbons 40 and 43 have been split to accept four balloons 76. It will be understood that any number of ribbons and balloons may be used by increasing the number of openings in the outer flange and/or splits in the ribbons.

Figure 6:
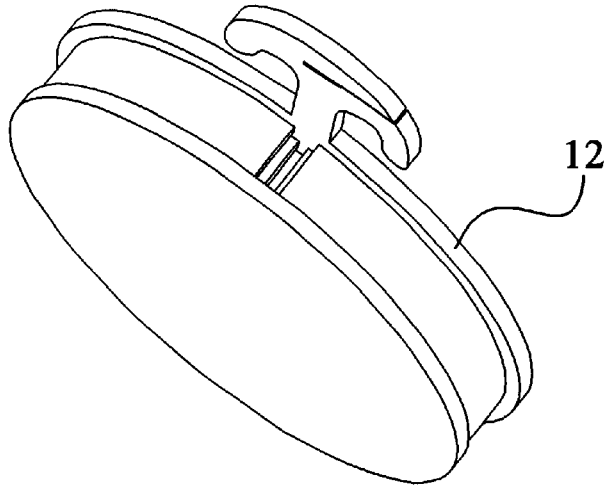
FIG. 6 is a top view of a balloon weight of an embodiment of the present invention.
Figure 7:
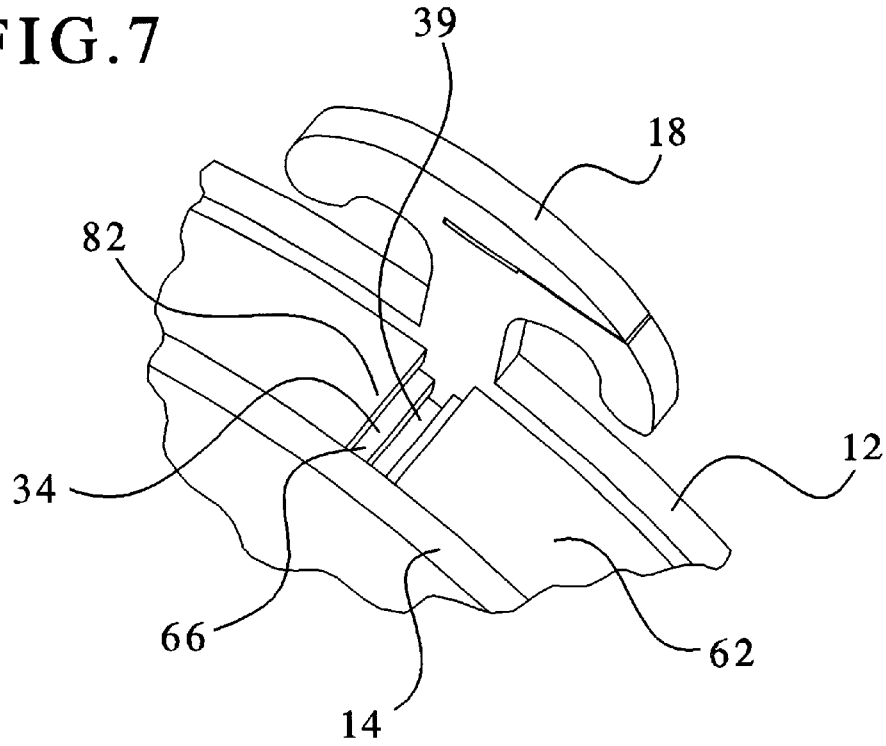
FIG. 7 is an enlarged view of a portion of the balloon weight of FIG. 6.
Figure 8:
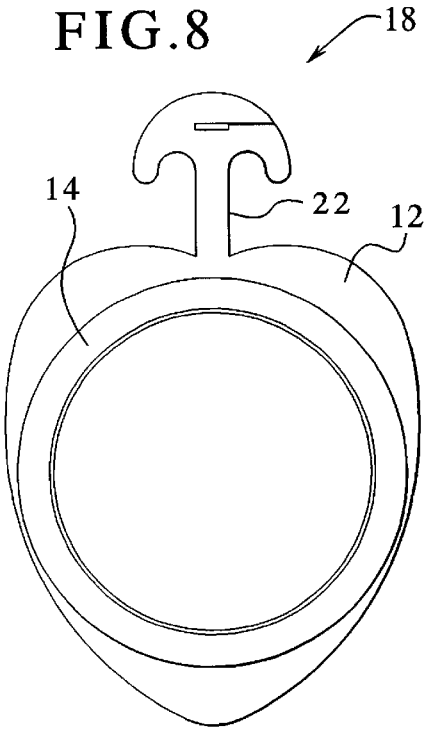
FIG. 8 is a front view of a balloon weight of an embodiment of the present invention.
Figure 9:
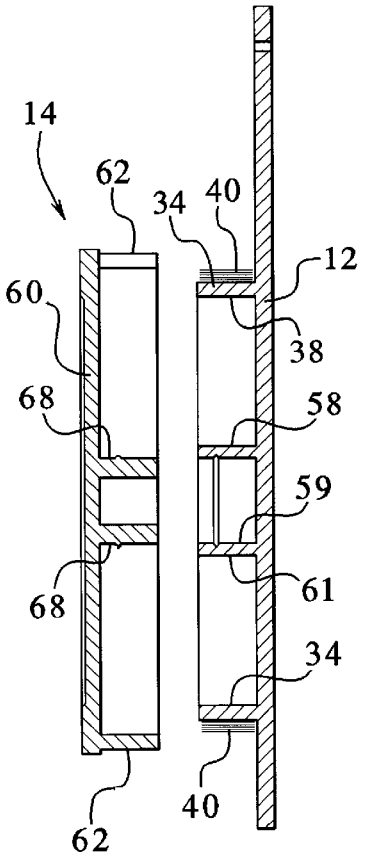
FIG. 9 is a side exploded view of the balloon weight of FIG. 8.
Figure 10:
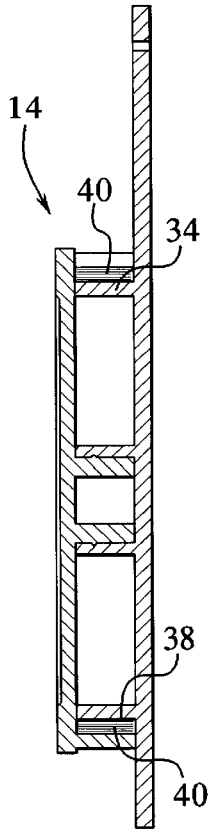
FIG. 10 is a side view of the balloon weight of FIG. 8.
Figure 11:
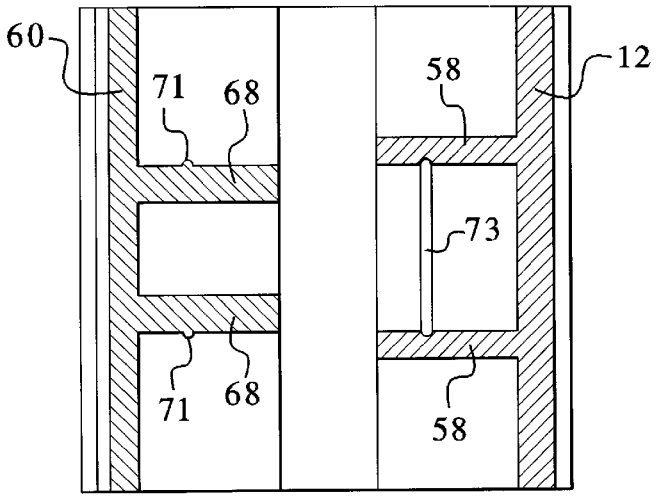
FIG. 11 is an enlarged view of the balloon weight of FIG. 9.
Figure 12:
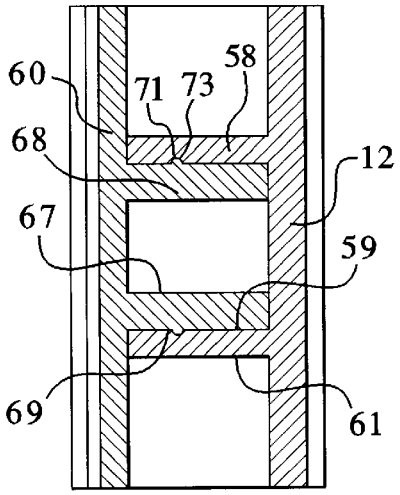
FIG. 12 is an enlarged view of the balloon weight of FIG. 10.

To retract the first ribbon 40 into the balloon weight 10, the cup 14 is rotated in the opposite direction with respect to the plate 12 that it rotated when the first ribbon 40 was being dispensed. Which direction will depend on whether the first ribbon 40 is wrapped clockwise or counterclockwise around the outer surface 38 of the outer flange 34. FIGS. 6 and 7 show a top view of the balloon weight 10. FIG. 7 is an enlarged view of a portion of FIG. 6. The first opening 39 in the outer flange 34 of the plate 12 is visible, as is the opening 66 in the side wall 62. As the cup 14 and plate 12 are rotated with respect to each other, the opening 66 rotates. When the cup 14 is rotated, the first ribbon 40 will again contact the side 82 of the opening 66 in the side wall 62. FIGS. 6 and 7 show a top view of the relative positions of the outer flange 34, edge 82 and sidewall 62. The first ribbon 40 will the be re-wrapped around the outer surface 38 of the other flange 34, causing the first ribbon 40 to retract into the balloon weight 10. If two ribbons are used both ribbons would be wound in the same direction about the outer flange 34. When the cup 14 is rotated, both ribbons will be re-wrapped around the outer surface 38 of the outer flange 34.

Figure 16:
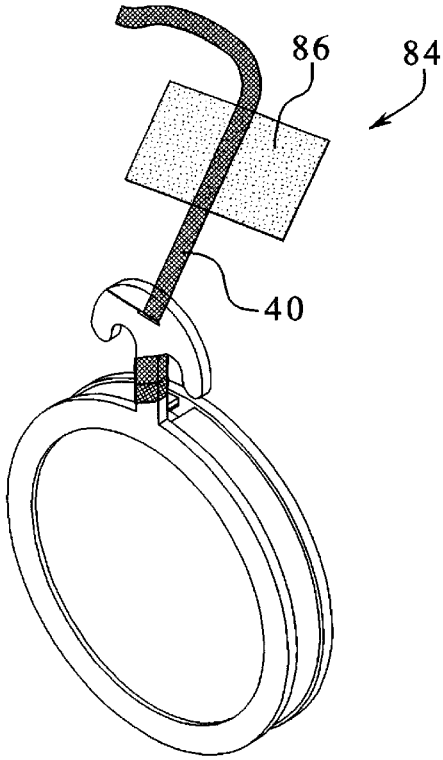
FIG. 16 is a perspective view of a balloon weight in accord with an embodiment of the present invention.
Figure 17:
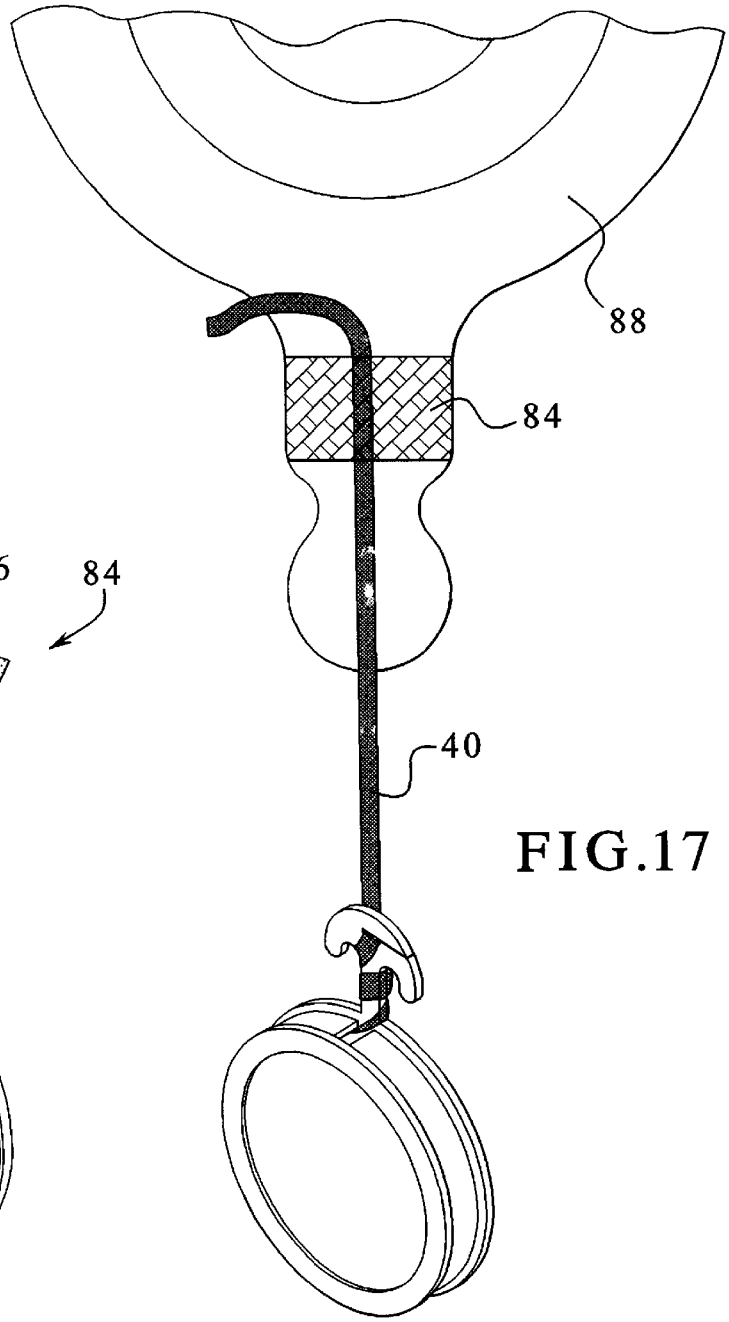
FIG. 17 is a perspective view of a balloon weight attached to a balloon in accord with an embodiment of the present invention.

FIGS. 16 and 17 show another embodiment of the balloon weight 10 where a piece of adhesive tape 84 is attached to the distal end of the first ribbon 40. The adhesive tape 84 is preferably coated with adhesive on only one side of the tape 84. A backing 86 covers the adhesive side of the tape 84 when the tape is not being used. Preferably, the backing 86 is longer or wider, or both longer and wider, than the adhesive tape 84. The first ribbon 40 is adhered to the tape 84 before the backing 86 is applied. To attach the adhesive tape 84 to a balloon 88, the backing 86 is removed exposing the adhesive which is then adhered to the balloon 88, thereby also attaching the ribbon 40 to the balloon 88.

It should be understood that various changes and modifications to the presently preferred embodiments described herein will be apparent to those skilled in the art. Such changes and modifications can be made without departing from the spirit and scope of the present invention and without diminishing its intended advantages. It is therefore intended that such changes and modifications be covered by the appended claims.

The invention is claimed as follows:

1. A balloon weight comprising:

a plate having a perimeter;

an annular outer flange disposed on the plate;

a cup rotatably connected to the plate, the cup having a bottom opposite the plate, the cup also having an annular side wall extending from the bottom, the side wall encompassing the outer flange, the side wall also including an opening; and an umbrella-shaped hook extending from the plate perimeter.

2. The weight of claim 1, further including a first ribbon wrapped around the outer surface of the outer flange, and extending through the opening in the side wall, the first ribbon having a length including a distal end, and a peg attached to the distal end of the first ribbon.

3. The assembly of claim 2, wherein the peg includes a pair of extensions, one extension on either side of the first ribbon.

4. The assembly of claim 1, wherein the plate has an indicia bearing surface.

5. The assembly of claim 4, wherein the indicia bearing surface includes an indicia.

6. The assembly of the claim 1, wherein the cup is rotatably connected to the plate such that the plate has a circular female inner flange disposed upon the plate, and wherein the cup bottom has a circular male flange insertable into the circular female inner flange.

7. The assembly of claim 6, further including a weight ring removably insertable between the inner female flange and outer flange of the plate.

8. The assembly of claim 7, wherein the weight ring includes a central opening to accommodate the inner female flange.

9. The assembly of claim 1, wherein the umbrella-shaped hook has a crown and an outer edge, and the crown includes a slot in communication with the outer edge.

10. The assembly of claim 1, wherein the outer flange has a first opening to receive a second end of the first ribbon.

11. The assembly of claim 10 wherein the outer flange has a second opening to receive a second end of a second ribbon.

12. The assembly of claim 2, wherein the peg has a first end and a second end, and one of the first end or second end includes a means for piercing the portion of the balloon.

13. The assembly of claim 6, wherein the female inner flange has an inner surface, and the inner surface includes an annular indentation, and the circular male flange includes an outer surface having an annular ring engageable with the annular indentation.

14. The assembly of claim 1, further including a first ribbon wrapped around the outer surface of the outer flange, and extending through the opening in the side wall, the first ribbon having a length including a distal end, and an adhesive tape attached to the distal end.

15. The assembly of claim 14, wherein the adhesive tape includes adhesive on a single side, and further includes a backing covering the adhesive.

16. The assembly of claim 15, wherein the backing is longer than the adhesive.

17. The assembly of claim 15, wherein the backing is wider than the adhesive.

18. The assembly of claim 15, wherein the backing is both longer and wider than the adhesive.

19. A balloon assembly comprising:

a balloon;

a balloon weight, the balloon weight including a plate having a perimeter, an annular outer flange disposed on the plate, the outer flange having an outer surface; a cup rotatably connected to the plate, the cup having a bottom opposite the plate, the cup also having an annular side wall, the side wall encompassing the outer flange, the side wall also including an opening, and an umbrella-shaped hook extending from the plate perimeter;

a first ribbon wrapped around the outer surface of the outer flange, and extending through the opening in the side wall, the first ribbon having a length including a distal end; and a peg attached to the distal end of the first ribbon, the peg insertable through a portion of the balloon to secure the distal end to the balloon.

20. The assembly of claim 19, wherein the balloon has an opening and the peg is insertable through the opening.

21. The assembly of claim 20, wherein the balloon opening has a width, and the peg has a length, and the length of the peg is greater than the width of the balloon opening.

22. The assembly of claim 19, wherein the peg includes a pair of extensions, one extension on either side of the first ribbon.

23. The assembly of claim 19, wherein the plate has an indicia bearing surface.

24. The assembly of claim 23, wherein the indicia bearing surface includes an indicia.

25. The assembly of the claim 19, wherein the cup is rotatably connected to the plate such that the plate has a circular female inner flange disposed upon the plate, and wherein the cup bottom has a circular male flange insertable into the circular female inner flange.

26. The assembly of claim 25, further including a weight ring removably insertable between the inner female flange and outer flange of the plate.

27. The assembly of claim 26, wherein the weight ring includes a central opening to accommodate the inner female flange.

28. The assembly of claim 19, wherein the umbrella-shaped hook has a crown and an outer edge, and the crown includes a slot in communication with the outer edge.

29. The assembly of claim 19, wherein the outer flange has a first opening to receive a second end of the first ribbon.

30. The assembly of claim 29 wherein the outer flange has a second opening to receive a second end of a second ribbon.

31. The assembly of claim 19, wherein the peg has a first end and a second end, and of the first end or second end includes a means for piercing the portion of the balloon.

32. The assembly of claim 25, wherein the female inner flange has an inner surface, and the inner surface includes an annular indentation, and the circular male flange includes an outer surface having an annular ring engageable with the annular indentation.

* * * * *